United States Patent [19]

Owens

[11] Patent Number: 4,842,329

[45] Date of Patent: Jun. 27, 1989

[54] PORTABLE SEAT

[76] Inventor: Russell P. Owens, 2159 S. Cholla, Mesa, Ariz. 85202

[21] Appl. No.: 201,754

[22] Filed: Jun. 3, 1988

[51] Int. Cl.[4] ..... A47C 13/00; A47C 7/62

[52] U.S. Cl. ..... 297/3; 297/188; 297/380

[58] Field of Search ..... 5/432, 433; 297/3, 230, 297/231, 277, 380, 453, 3

[56] References Cited

U.S. PATENT DOCUMENTS

| | | | |
|---|---|---|---|
| 190,788 | 5/1977 | Smith | 297/380 X |
| 1,625,106 | 4/1927 | Sullivan | 297/380 X |
| 2,239,669 | 4/1941 | Blake | 297/380 X |
| 4,190,918 | 3/1980 | Harvell | 297/230 X |
| 4,457,032 | 7/1984 | Clarke | 297/230 X |
| 4,715,652 | 12/1987 | Ward | 297/188 X |

FOREIGN PATENT DOCUMENTS

| | | | |
|---|---|---|---|
| 674942 | 11/1964 | Italy | 297/377 |

*Primary Examiner*—James T. McCall

*Attorney, Agent, or Firm*—Gregory J. Nelson

[57] ABSTRACT

A portable, foldable seating device having a seat and backrest pivotally connected to one another. A U-shaped support is pivotally attached to the seat and in a stored position the back and seat engage in a generally parallel abutting relationship with the support extending to provide a carrying handle. In the use-position as a seat, the support secures the back in a generally vertical position with respect to the seat. The seat may be used with the backrest upright on a relatively flat surface or may be inverted with the backrest serving as a support leg and the bottom of the cushion upwardly facing to provide a seating surface on an incline or hillside.

7 Claims, 2 Drawing Sheets

PORTABLE SEAT

The present invention relates to a portable seat and more particularly relates to a portable seat which may be conveniently transported and unfolded and used at such activities as athletic events and outdoor activities.

It is common that the seating at many athletic arenas and stadia are of the bleacher or bench-type which become uncomfortable to the patron after use for a period of time. For example, a football game may last in excess of three hours and the hard surface and lack of back support can cause substantial discomfort to the patron during such period of time. Accordingly, it is not uncommon for the sports fan to carry a simple seat cushion for use during athletic events. Such cushions typically have some type of resilient material such as a foam pad enclosed in a fabric or plastic covering which cushion is placed on the bleacher.

Such cushions afford some degree of comfort but are limited in that they are generally usable with bleacher or bench-type seats and further do not offer any back support.

Another common type of portable seat for use in connection with bleacher seating has a padded or cushioned seat portion with a back which is pivotally attached to the seat portion. The seat is placed on the bench or bleacher and the back support moved to an upright position. This type of seat offers more comfort than the simple cushion in that it provides some back support but has the disadvantage that such seating devices are limited in use with bleacher or bench-type seats and are not generally useable on inclined surfaces. Further, such seating devices are often constructed of tubular aluminum or similar frame material and are expensive, unwieldy and heavy making them difficult to transport and set-up.

In view of the foregoing, there exists a need for a convenient, inexpensive, light-weight seating device which may be used in connection with bleacher or bench seats and further which is usable in other environments as for example in connection with outdoor activities where the user wishes to have a comfortable and generally horizontal seating surface on the side of a hill. This situation is common in viewing athletic events such as golf tournaments.

Briefly, the present invention provides a lightweight, portable and highly versatile seating device which is adaptable for use in various environments and locations. The seating device, for example, may be used in connection with flat surfaces such as bleacher or bench seats to provide a cushioned seating surface and cushioned back support. The device may also be inverted and used to provide a substantially horizontal cushioned seating surface on an inclined surface such as the side of a hill. The invention is also designed for the inclusion of a detachable tray for holding food or beverage items. One or more pockets may also be provided in an attached apron for conveniently carrying personal items when the chair is folded into the compact storage and transporting position.

The seat of the present invention includes a generally rigid backrest and seat unit which are hingedly secured to one another. The backrest is provided with a resilient cushion oriented to engage and support at least the upper back area of the user. The seat unit has a rigid panel with resilient cushions on opposite sides of the panel and the backrest and seat unit are preferably covered with a suitable moisture-resistant and cleanable covering such as a vinyl or other plastic material. A generally U-shaped support member is pivotally secured to the rigid seat panel and in the collapsed position assumes a position generally parallel to the seat panel to provide a handle for the convenient transportation of the seat. In the unfolded position, the support member engages the backrest and secures it in a generally perpendicular position with respect to the seat panel. In this position, the seat may be placed on a bench or other surface to provide cushioned seating and back support for the user. The seat can be inverted and used on an inclined surface with the resilient cushion on the underside of the rigid seat panel oriented upwardly to provide a generally horizontal seating surface. The seat may also be extended to a generally flat position with the backrest and seat unit generally aligned and in this position used as a lounge pad for the head and upper body of the user when the user reclines. A holder may be engaged between the backrest and a portion of the support to provide a surface for retention of food, beverage and other items when the support is in a position engaging the backrest.

The above and other advantages of the present invention will become more apparent from the following description, claims and drawings in which:

Figure 1:
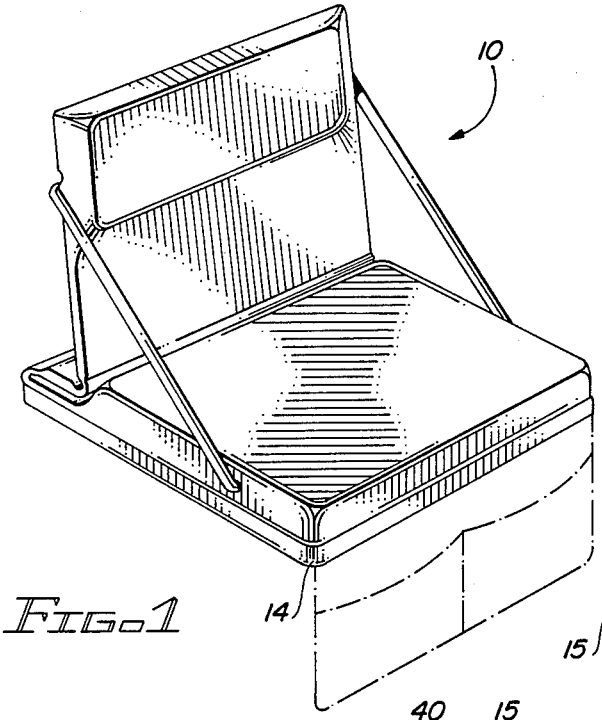
FIG. 1 is a perspective view of the seating device of the present invention in an unfolded position suitable for use as a seat on a relatively flat surface.

Turning now to the drawings, the seat of the present inveniton is generally designated by the numeral 10 and has a generally rectangular seat panel 12 which may be fabricated from any suitable rigid material such as plywood or plastic sheet. The seat panel typically is approximately ¼"-5/16" thick having front edge 14 and rear edge 15 and opposite side edges 16 and 17. The seat panel has a planar surface 18 which for purposes of orientation in the normal use-position as referred to as the top side of the panel and an opposite surface 20 which in the normal use-position would be designated as the bottom surface.

The bottom surface 20 is substantially entirely covered with a resilient material such as an expanded foam pad 22 which typically is approximately one inch thick. The upper surface 18 of the seat panel is partially covered with a resilient pad 25 which extends from the front edge 14 of the panel to a position inward of the rear edge 15 of the panel so that a recess 26 exists at the rear of pad 25. Pad 25 extends between the opposite side edges 16 and 17 of the panel 12 and is typically approximately two inches thick. The upper resilient pad 25, rigid panel 15 and bottom resilient pad 72 form the seat unit 28 of the seating device. The entire seat unit 28 is encased by a moisture-proof cover 25 such as polyethylene or polyvinyl chloride and is sealed at appropriate seams by heat sealing or dieletric sealing techniques as are well known in the art. Pads 22 and 25 may be joined to the intermediate rigid panel 12 by application of conventional adhesives.

The backrest 35 includes a rigid panel 36 which is generally rectangular having opposite sides 37 and 38, top edge 39, and bottom edge 40. Backrest panel 36 has an front planar surface 42 and a back planar surface 43 as viewed in FIG. 2. A resilient pad 45 is adhesively or otherwise secured to the front surface of panel 45 extending from the upper edge 39 of the panel downwardly terminating at approximately the midpoint of the panel. The rigid panel 36 and foam pad 45 are encased in a suitable moisture-resistant material 48 such as a polyethylene or polyvinyl chloride which may be heat sealed or dielectrically sealed at the edge seams. In practice, the entire covering extending over the seat unit and backrest may be a single piece of material appropriately seamed.

Figure 3:
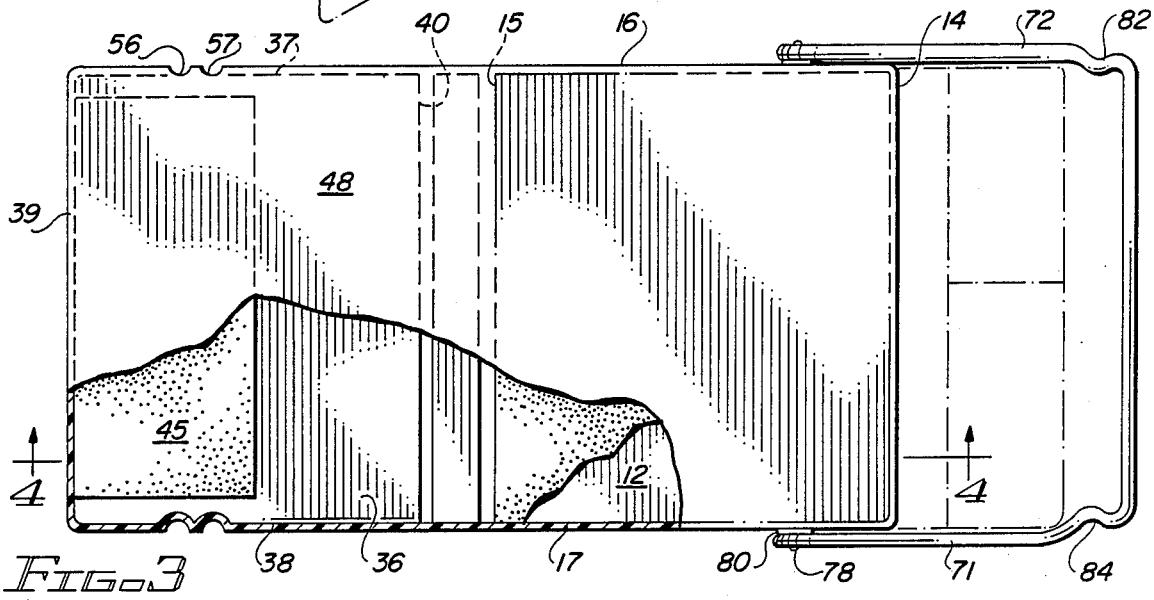
FIG. 3 is a plan view, partly broken away, showing the seat in a horizontal position suitable for use as a pad.

As seen in FIG. 3, the back pad 45 terminates inwardly at the opposite side edges 37, 38 of the back panel. The side edges 37, 38 of the back panel 36 define a plurality of pairs of generally semi-circular opposed notches 56 and 57. As will be explained hereafter, these notches are adapted to engage the support rod 70 to provide for adjustability of the backrest portion of the seat relative to the seat portion.

Figure 2:
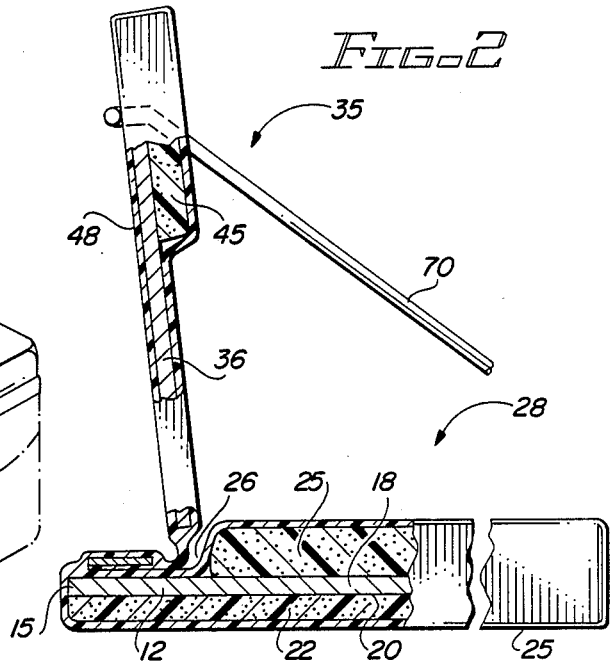
FIG. 2 is a side view of the seat of the present invention in the unfolded position suitable for use as a seat on a relatively flat surface.

The backrest 35 is pivotally secured to the seat portion by means of a flexible hinge 60. A flexible section of material 62 extends from the lower edge 40 of the rigid back panel 42. The flexible extension is attached which is shown as an extension of the covering on the underside of either the backrest or seat unit. A transverse rigid hinge member 65 is secured to the upper surface of the extension 62. The hinge member extends transversely the width of the seat and has a width approximately that of the thickness of the seat unit. The covering on the backrest extends over the hinge member with a flexible transversely extending joint 65 and 66 at either side of the hinge members 65 which joint are formed by the flexible cover. In this way, the backrest can be adjusted to the desired angular position with respect to the seat panel as shown in FIG. 2. Similarly, the backrest may be folded to the carrying position shown in FIG. 5 with the seat unit and the backrest in generally horizontal abutting relationship. The flexible hinge 60 assumes a position along recess 26 when the seat is in the position shown in FIGS. 1 and 2. When the seat is collapsed to the position of FIG. 5, the hinge 60 extends in a generally perpendicular bridge position between the edges of the seat and backrest permitting collapse of the seat with the seat unit and backrest abutting.

The seat includes a support member 70 which is generally U-shaped having opposite parallel arms 71 and 72 and interconnecting bight portion 75. Support 70 may be metal or plastic tubing. The distal ends of the arms 71, 72 are pivotally secured to the seat panel 15 by pivot pins 78 extending through bores rear of the ends of the arms. The pins extend into reinforcing blocks 80 positioned at an intermediate position along the opposite sides of the rigid panel at an approximate location spaced inwardly from edge 14 a distance one-third of the overall front-to-back length of the panel. Support 70 is formed having opposed inwardly indented sections 82 and 84 which form detents which are engageable in notches 56, 57 when the backrest is in the position as shown in FIGS. 1 and 2. The relative position of the backrest structure and the seat structure is adjustable by selective engagement of the detent sections 82, 84 in the notches. For example, by engaging the detents in the upper-most notches 56, a more vertically oriented position of the backrest relative to the seat component is obtained. Movement of the detents 82, 84 downwardly to notches 57 allows the backrest to pivot rearwardly away from the vertical position at the option of the user. Additional motches may be provided if desired.

Figure 6:
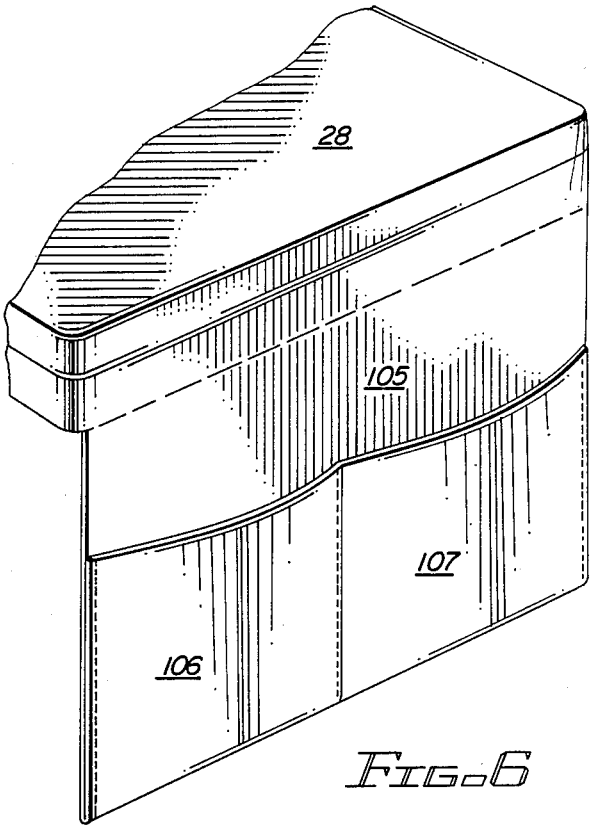
FIG. 6 is a partial perspective view of the front edge of the seat unit with an attached accessory for containing personal articles.
Figure 8:
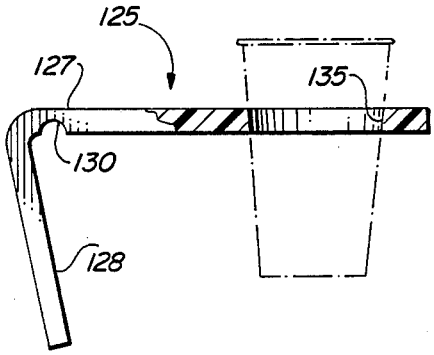
FIG. 8 is a sectional view taken along lines 8—8 of FIG. 7.

As seen in FIG. 6, a storage apron 100 may be either detachably or integrally formed as a part of the seat component. The apron 100 includes one or more pockets 106, 107 preferably formed of the same moisture resistant material as the covering on the seat and backrest portion of the device. Pockets 106 and 107 can be formed in any desired shape and size and include a marginal area 105 extending across the top of the pockets. The marginal edge 105 may be permanently secured to the front vertical edge of the seat unit 28 as shown or may be secured by means of releasable snaps or fabric loop and hook fastener members such as the type sold under the trademark Velcro. When the apron 100 is attached, it will assume a position between the backrest and seat unit in the folded position convenient for storage or carrying.

Figure 5:
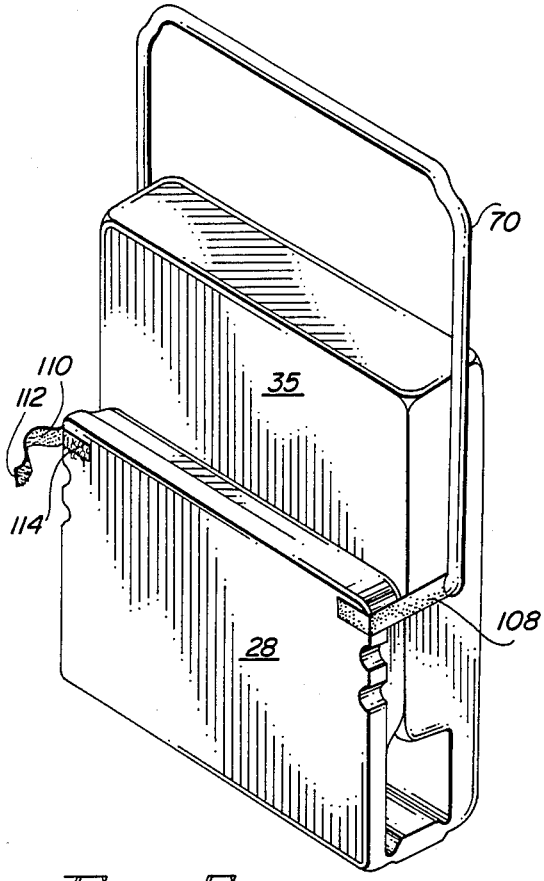
FIG. 5 is a perspective view of the seat of the present invention in the folded carrying position.

In use, the device is light-weight, highly portable and may be selectively positioned depending upon the preference of the user and the use environment. In the normal carrying and storage position, the seating device is collapsed as shown in FIG. 5 with the backrest 35 and seat unit 28 in juxtaposition with the backrest in generally parallel orientation. The support 70 extends upwardly generally aligned with the rigid seat panel 15 so that the bight section 75 forms a convenient carrying handle. The hinge 60, being flexibly connected at either edge, permits the seat unit and backrest to assume a position extending generally perpendicular between the backrest and seat unit. The backrest and seat unit are held in the position shown in FIG. 5 by a pair of opposed straps 108 to 110 which are affixed at one end to seat cushion at a location approximately corresponding to the location of the pivot pins. The opposite ends of the straps 108 and 110 are provided with releasable fastener member 112 which is cooperable with the fastener member 114 on the bottom side of the seat unit 28. Cooperable fastener members of loop and hook type sold under the trademark Velcro are suitable for this purpose.

In the event the user wishes to use the seat 10 in connection with a flat surface such as a bench or bleacher-type seat, the retaining straps 108 and 110 are released allowing the backrest 28 to be unfolded relative to the seat unit 28. The seat unit is placed on the supporting surface with the cushion 25 disposed upwardly. The backrest 28 is locked into position by engaging the detent portions 82, 84 of the support member 70 in selected notches at the opposite sides of the backrest. Apron 105 hangs vertically downwardly at the front edge of seat cushion 28 for convenient containment of personal items in pockets 106 and 107. This position, the seating device of the present invention provides a comfortable seat and a supporting backrest for the user. When the user wishes to leave, the seat may be conveniently folded to the position shown in FIG. 2 and the temporary restraining straps 108, 110 engaged to provide a compact unit for carrying and storage. In the folded position apron 105 will assume a position between the backrest 28 and seat unit 35 securing the contents of pockets 106 and 107.

Figure 7:
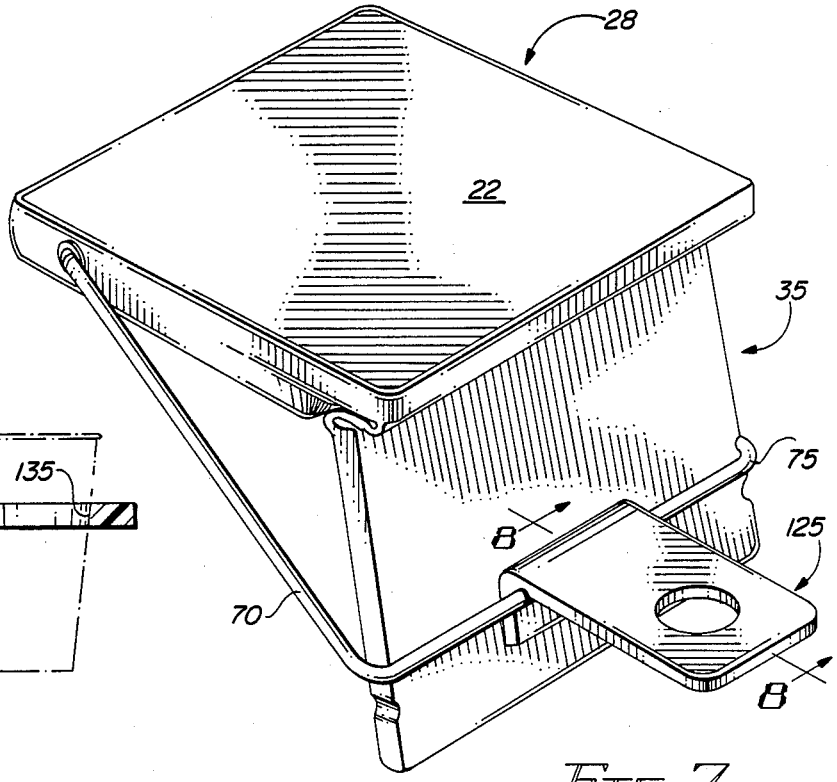
FIG. 7 is a perspective view of the portable seat of the present invention in an inverted position suitable for use on an inclined or hill surface and further showing the optional tray holder in position.

In the event the user wishes to use the seat on an inclined surface such as a hillside while viewing an event such as a golf tournament, the seat is unfolded and assembled in the use-position as described above with the support 80 engaging selected opposed notches along the opposite sides of the backrest. In this environment, the entire seating device can be inverted to a position as shown in FIG. 7 with the pad 22 upwardly disposed. The support member 70 allows the backrest 35 to serve as a support leg to be adjusted relative to the seat 28 in accordance with the angle of incline of the surface on which the seat is to be used. Pad 22 now becomes the seating surface and assumes a generally horizontal position on which the user may sit.

If desired, the user may also place the optional tray 125 in engagement with the bight section 75 of the support 70 to hold food or beverages. The support tray includes a tray section 127 and a depending flange member 128. The flange member is provided with a transversely extending recess 130 so that the flange may be engaged between the backrest 35 and transversely extending bight section 75 of the support 70 to secure the tray holder in place. The tray holder surface may be provided with one or more apertures 135 conveniently sized to accomodate a tumbler, beverage cup or other item such as a fishing rod.

Figure 4:
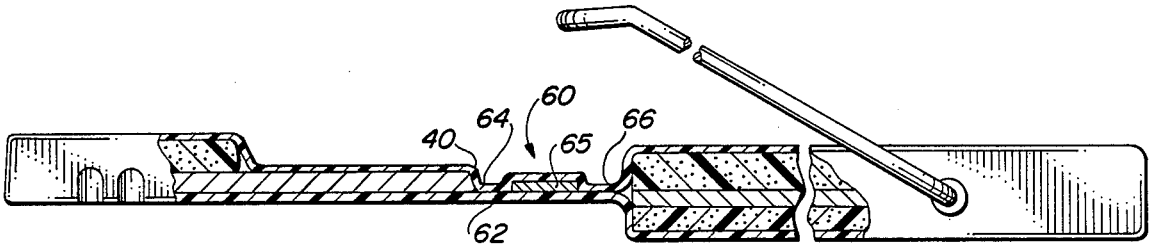
FIG. 4 is a partial sectional view taken along lines 4—4 of FIG. 3.

The seat may also be used as a lounge pad if extended to the generally horizontal position shown in FIGS. 3 and 4. Here the seat is extended with the seat unit and backrest aligned and may be placed on a surface and the user may recline using the seat to support the user's head and upper torso.

At the conclusion of the event, the plastic holder may be removed and the seat folded to the carrying and storage position shown in FIG. 3.

The foregoing describes my portable, foldable seating device. It will be understood that various changes, alterations and modifications to the embodiments of the invention herein may be made by those skilled in the art without departing from the spirit and scope of the appended claims.

I claim:

1. A portable, temporary seating device comprising:

(a) a seat member with opposite surfaces having front, rear and side edges, said seat member having top and bottom cushions disposed on said opposite surfaces with said top cushion defining a transverse recess along the rear edge;

(b) a backrest including a rigid panel with a front and rear side having a top, bottom and side edges, said backrest having locking members associated therewith, said backrest being pivotally secured at the bottom edge thereof to the said rear edge of said seat member at a flexible hinge transversely extending in the area of said recess;

(c) generally U-shaped rigid support means having side arms and a bight portion, said side arms being pivotally secured to said seat member whereby said seating device may be folded to a carrying position with the backrest and seat member in generally parallel relationship with the support means extending generally parallel thereto to form a handle and said seat being positionable with the backrest disposed at an upstanding position with respect to the seat member and with the support member engaging said locking members with the bight portion at least partially engaging said rear side of said backrest to support same whereby the seating device may be disposed for use in a first position on a relatively flat surface with the backrest generally upstanding and the top cushion facing upwardly and whereby the seating device may be disposed in an inverted position for use in a second position on an inclined surface with the backrest depending to support the seat member in a generally horizontal position with the bottom cushion upwardly facing.

2. The seating device of claim 1 wherein said seat member and said backrest are covered with a moisture proof material.

3. The seating device of claim 2 wherein said moisture proof material is a polymeric material.

4. The seating device of claim 1 wherein said locking member comprises opposed notches defined by the side edges of said backrest rigid panel and wherein said support means includes detent member associated therewith detachably engageable with said notches.

5. The seating device of claim 1 further including apron panel means secured to said seat member, said apron means defining pocket means therein.

6. The seating device of claim 1 further including holder member having a tray surface and depending flange means, said flange engageable with said bight portion of said support in the use-position to secure said tray surface in a generally horizontal position.

7. The seating device of claim 1 further including detachable retainer means for securing said members in said carrying position.

* * * * *